US007444099B2

(12) United States Patent
Eguchi

(10) Patent No.: US 7,444,099 B2
(45) Date of Patent: Oct. 28, 2008

(54) IMAGE PROCESSING APPARATUS AND ADJUSTING MEMBER OF POSITION OF CENTER OF GRAVITY

(75) Inventor: Naomi Eguchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 252 days.

(21) Appl. No.: 11/526,694

(22) Filed: Sep. 26, 2006

(65) Prior Publication Data

US 2007/0071493 A1 Mar. 29, 2007

(30) Foreign Application Priority Data

Sep. 29, 2005 (JP) ..... 2005-284848

(51) Int. Cl.
*G03G 15/00* (2006.01)

(52) U.S. Cl. ..... 399/107

(58) Field of Classification Search ..... 399/107, 399/110, 124, 126

See application file for complete search history.

(56) References Cited

U.S. PATENT DOCUMENTS 7,376,370 B2 * 5/2008 Imada et al. ..... 399/107
2004/0247337 A1 * 12/2004 Ohama et al. ..... 399/107

FOREIGN PATENT DOCUMENTS

JP 2005-053648 3/2005

* cited by examiner

*Primary Examiner*—Hoang Ngo
(74) *Attorney, Agent, or Firm*—Rabin & Berdo PC

(57) ABSTRACT

A closable member is arranged in an upper portion of an apparatus main body. A center of gravity is shifted by opening the closable member. The apparatus has an adjusting member of the position of the center of gravity which is arranged out of the apparatus main body so as to be projected therefrom in an edge portion on the side where the center of gravity in the apparatus main body is shifted. Since the closable member can be opened by about 90°, the operability upon performing maintenance of a multi function printer can be improved.

13 Claims, 12 Drawing Sheets

PRIOR ART

IMAGE PROCESSING APPARATUS AND ADJUSTING MEMBER OF POSITION OF CENTER OF GRAVITY

BACKGROUND OF THE INVENTION

1. Field of the Invention

The invention relates to an image processing apparatus and an adjusting member of a position of a center of gravity.

2. Description of the Related Art

Hitherto, image processing apparatuses each having at least two or more functions of a printer, a copying apparatus, a facsimile apparatus, a scanner, and the like have been provided. For example, an MFP (Multi Function Printer) as one of those image processing apparatuses has the function of the printer and the function of the scanner.

In the MFP in which an image reading unit as a second image processing unit having the scanner function is arranged over an image forming apparatus as a first image processing unit having the printer function, when the image forming apparatus is operated, since it is necessary to open the image reading unit, the image reading unit is opened by a predetermined angle (about 30° to 45°).

FIG. 2 is a schematic diagram of a conventional MFP.

In the diagram, reference numeral 11 denotes an image forming apparatus as a first image processing unit having the printer function; 21 a sheet; 12 a sheet cassette for enclosing the sheets 21; 13 a feed roller which is arranged at a position adjacent to a front edge of the sheet cassette 12 and separates and supplies the sheets 21 one by one; 14 a conveying roller which is arranged on a downstream side of the feed roller 13 in the conveying direction of the sheet 21 and conveys the supplied sheet 21; 15 a sensor for detecting a front edge of the sheet 21 which is conveyed; 16 an image forming unit which is constructed by photosensitive drums and the like and forms a toner image of each color; 31 a transfer unit for sequentially transferring the toner images formed by the image forming unit 16 onto the sheet 21, thereby forming a color toner image; 17 a fixing unit for fixing the color toner image onto the sheet 21, thereby forming a color image; 18 a top cover which is closably arranged so that it can freely swing around a rotational fulcrum 19; and 22 an image reading apparatus which is arranged over the top cover 18 and functions as a second image processing unit having the scanner function. The MFP is constructed by the image forming apparatus 11 and the image reading apparatus 22.

In the image forming apparatus 11 with the above construction, when image data is transmitted from a host computer (not shown), a control unit (not shown) allows the feed roller 13 to rotate so as to pick up and feed the sheets 21 one by one from the sheet cassette 12, thereby conveying the sheet 21 by the conveying roller 14 to a position between the image forming unit 16 and the transfer unit 31. The control unit allows the transfer unit 31 to sequentially transfer the toner images of the respective colors formed by the image forming unit 16 onto the sheet 21, thereby forming the color toner image. The control unit further allows the fixing unit 17 to fix the color toner image onto the sheet 21, thereby forming the color image. After that, the sheet 21 is ejected onto a stacker formed by the top cover 18.

In the case where an image formed on a predetermined sheet as original paper is copied onto another sheet 21, the image reading apparatus 22 reads the image and transmits data of the read image, that is, image data to the image forming apparatus 11. In the image forming apparatus 11, when the image data is transmitted, the control unit forms the color image in the foregoing procedure. Therefore, the same image as the image which has been read by the image reading apparatus 22 can be formed.

However, since the top cover 18 can be opened only by an angle within the range of about 30° to 45° in the above conventional MFP, in the case where the maintenance of the image forming apparatus 11 is made, for example, there is such a problem that the operability deteriorates when a sheet jam on a medium conveying path is eliminated or consumables such as image forming unit 16, fixing unit 17, or the like are exchanged.

SUMMARY OF THE INVENTION

It is, therefore, an object of the invention to provide an image processing apparatus which can solve the problems in the conventional MFP and improve the operability.

According to the present invention, there is provided an image processing apparatus in which a closable member is arranged in an upper portion of an apparatus main body and a center of gravity is shifted by opening the closable member, comprising an adjusting member of a position of the center of gravity which is arranged out of the apparatus main body in an edge portion on the side where the center of gravity in the apparatus main body is shifted and which is formed so as to be projected from the apparatus main body.

Moreover, in the image processing apparatus, the adjusting member of the position of the center of gravity may be arranged so that it can be enclosed in the apparatus main body.

Moreover, in the image processing apparatus, the adjusting member of the position of the center of gravity may be arranged so as to be detachable for the apparatus main body.

Moreover, in the image processing apparatus, the adjusting member of the position of the center of gravity may be set into the apparatus main body by allowing engaging portions to be come into engagement with engagement portions.

Moreover, in the image processing apparatus, the adjusting member of the position of the center of gravity may be set into an auxiliary tray by allowing an engaging portion to be come into engagement with an engagement portion.

Moreover, in the image processing apparatus, an elastic member may be arranged on a bottom portion of the adjusting member.

Moreover, in the image processing apparatus, the adjusting member may have engaging portions which are come into engagement with groove portions formed in the apparatus main body; and urging members which urge the engaging portions in such a direction as to be come into engagement with the groove portions.

Further, according to the present invention, there is provided an adjusting member of a position of a center of gravity, comprising a plate-shaped base portion which is flat in a horizontal direction; arm portions extending in a same direction in both edge portions of the base portion; and block-shaped convex portions projecting upward from the arm portions.

Moreover, in the adjusting member, the base portion may have protruding portions protruding upward from the base portion and hole portions.

Moreover, in the adjusting member, the convex portions may have claw portions projecting from the convex portions; and urging members which urge the claw portions in their projecting direction.

Furthermore, according to the present invention, there is provided an adjusting member of a position of a center of gravity which is detachable for an image processing apparatus for reading an original sheet and forming an image of contents of the original sheet, comprising a plate-shaped base portion which faces a bottom surface of the image processing apparatus; arm portions extending in a same direction in both edge portions of the base portion; and block-shaped convex portions projecting upward from the arm portions, wherein the base portion has protruding portions protruding upward and hole portions.

Moreover, in the adjusting member, the base portion may have the protruding portions which protrude upward from the base portion and are come into engagement with recess portions of the image processing apparatus; and the hole portions which enclose leg portions of the image processing apparatus.

Moreover, in the adjusting member, the convex portions may have claw portions which are arranged so as to be projected from the convex portions and are come into engagement with groove portions of the image processing apparatus and urging members which urge the claw portions in their projecting direction.

According to the invention, in the image processing apparatus, the closable member is arranged in an upper portion of the apparatus main body and the center of gravity is shifted by opening the closable member.

The apparatus has the adjusting member of the position of the center of gravity which is arranged out of the apparatus main body in the edge portion on the side where the center of gravity in the apparatus main body is shifted and which is formed so as to be projected from the apparatus main body.

In this case, since the adjusting member of the position of the center of gravity is arranged, the closable member can be opened by about 90°. Therefore, the operability can be improved.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Embodiments of the invention will be described in detail hereinbelow with reference to the drawings. In this case, an MFP (Multi Function Printer) as an image processing apparatus will be described.

Figure 1:
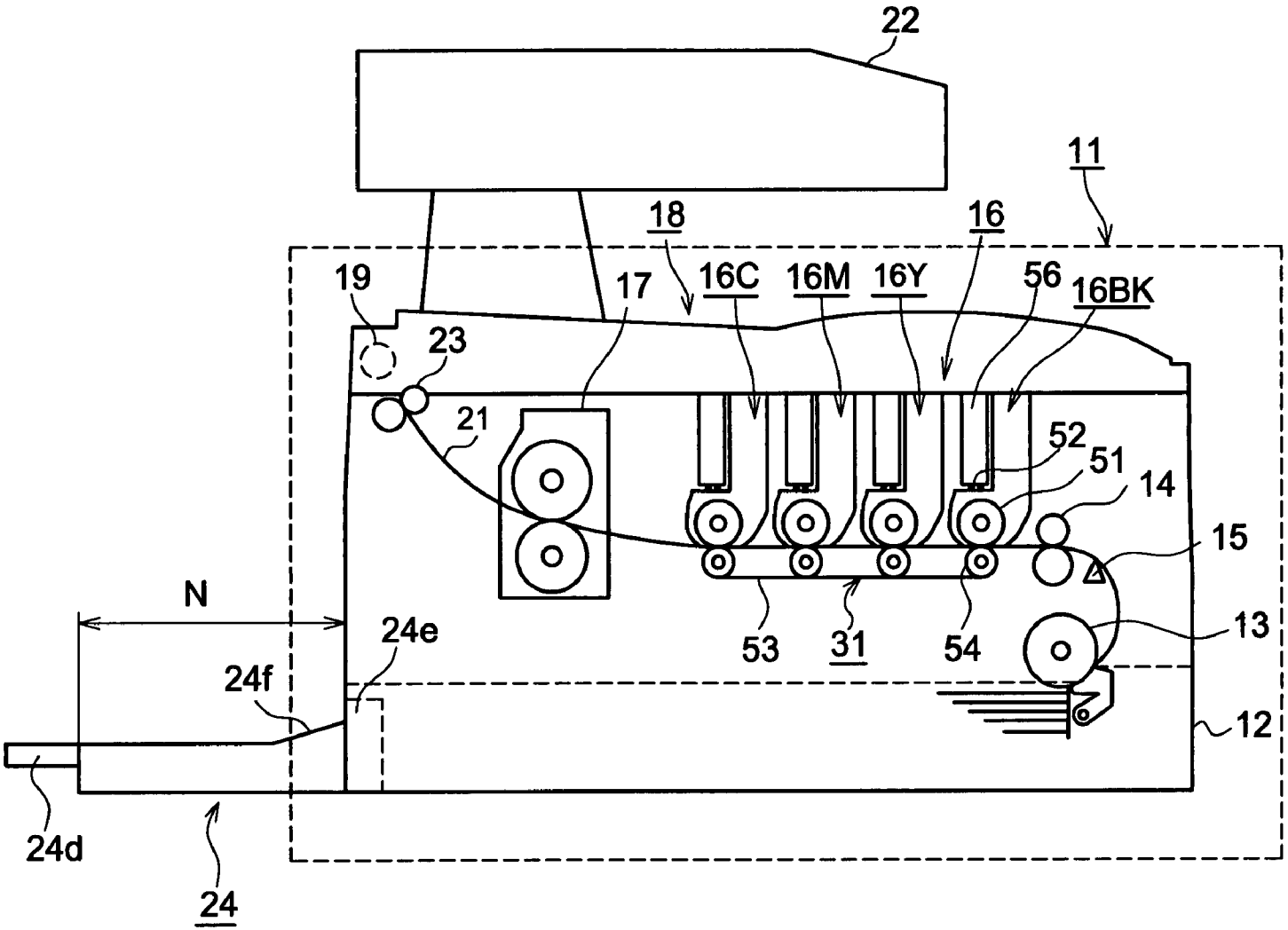
FIG. 1 is a diagram showing the state where an adjusting member of the position of the center of gravity in the first embodiment of the invention has been arranged at a pulling-out position.
Figure 2:
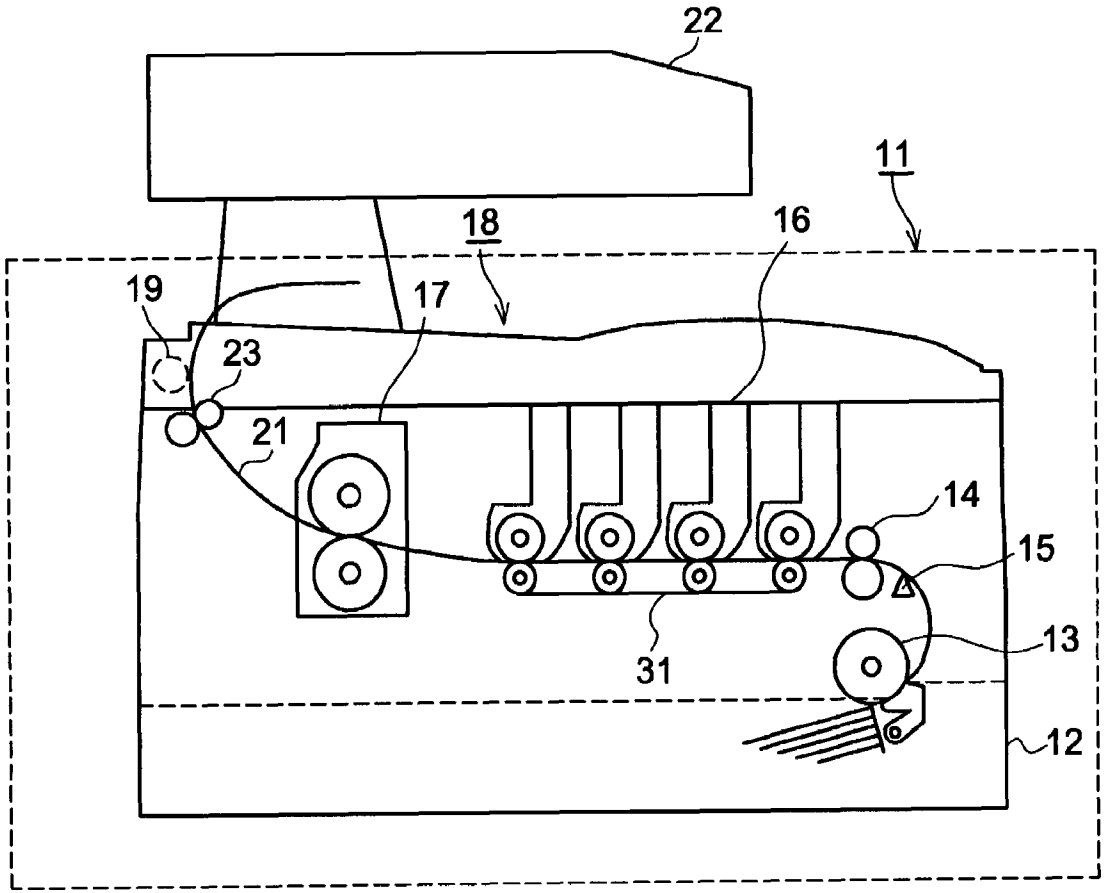
FIG. 2 is a schematic diagram of a conventional MFP.
Figure 3:
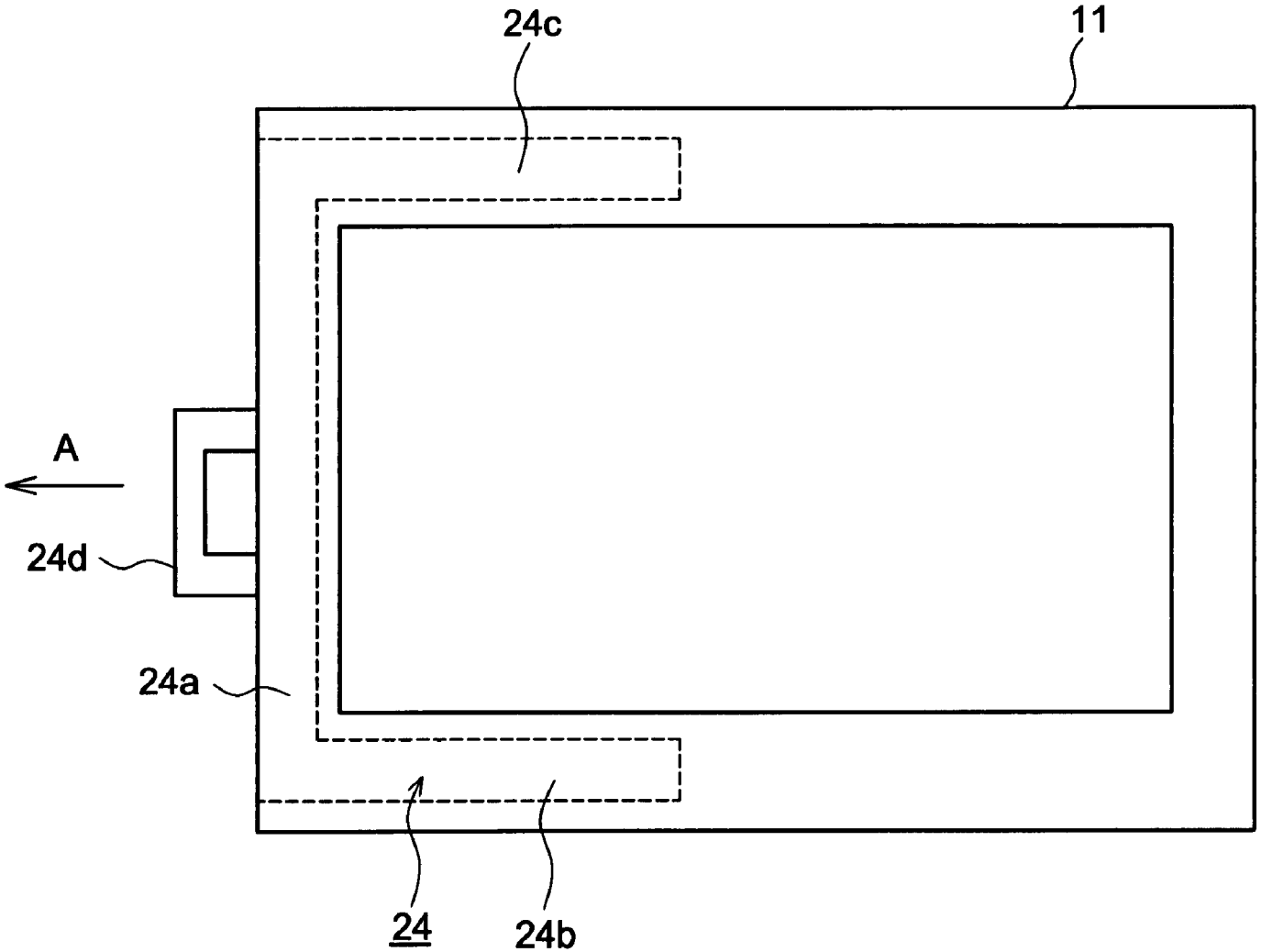
FIG. 3 is a bottom view of an image forming apparatus in the first embodiment of the invention.
Figure 4:
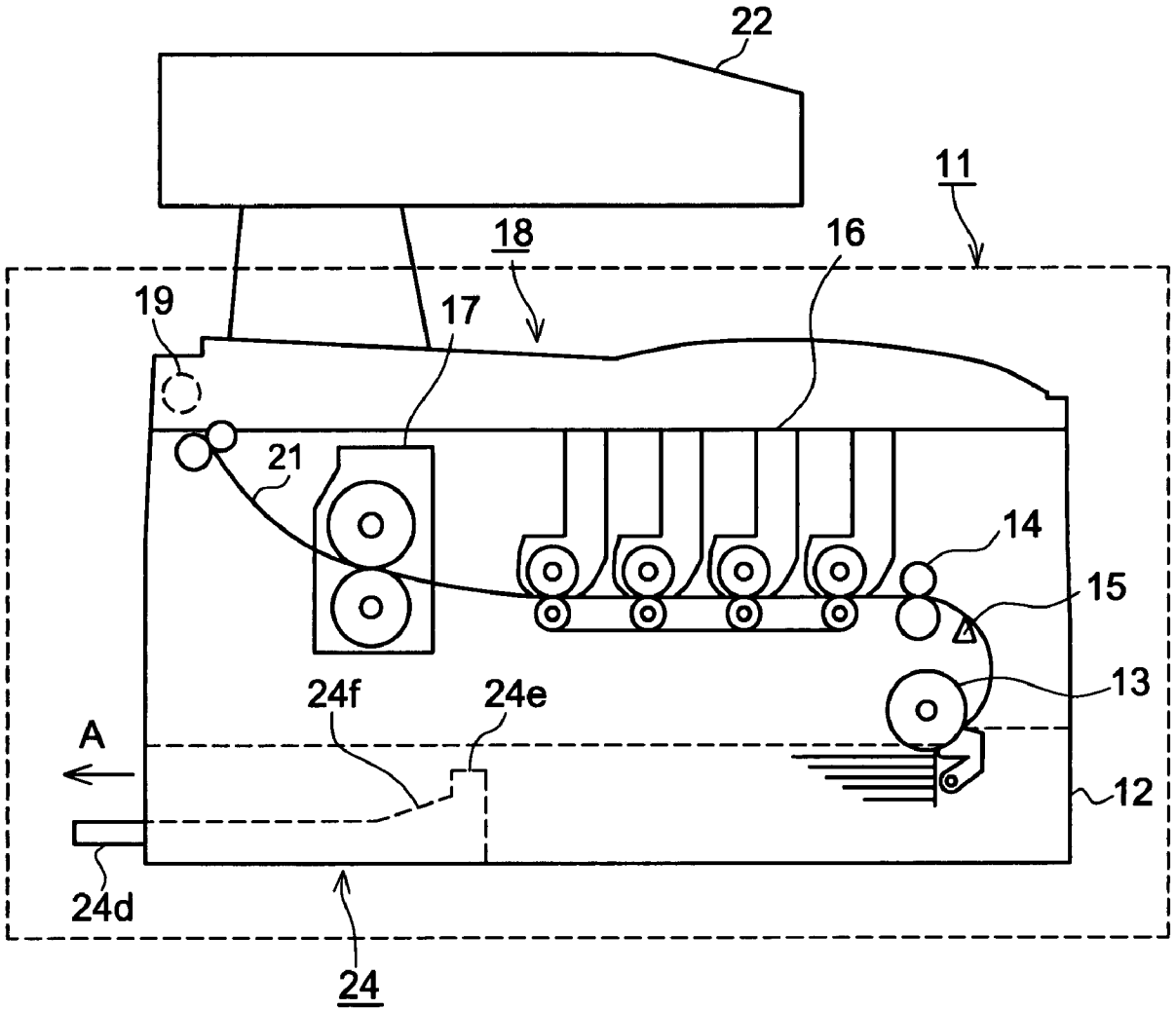
FIG. 4 is a diagram showing the state where the adjusting member of the position of the center of gravity in the first embodiment of the invention has been arranged at an enclosing position.
Figure 5:
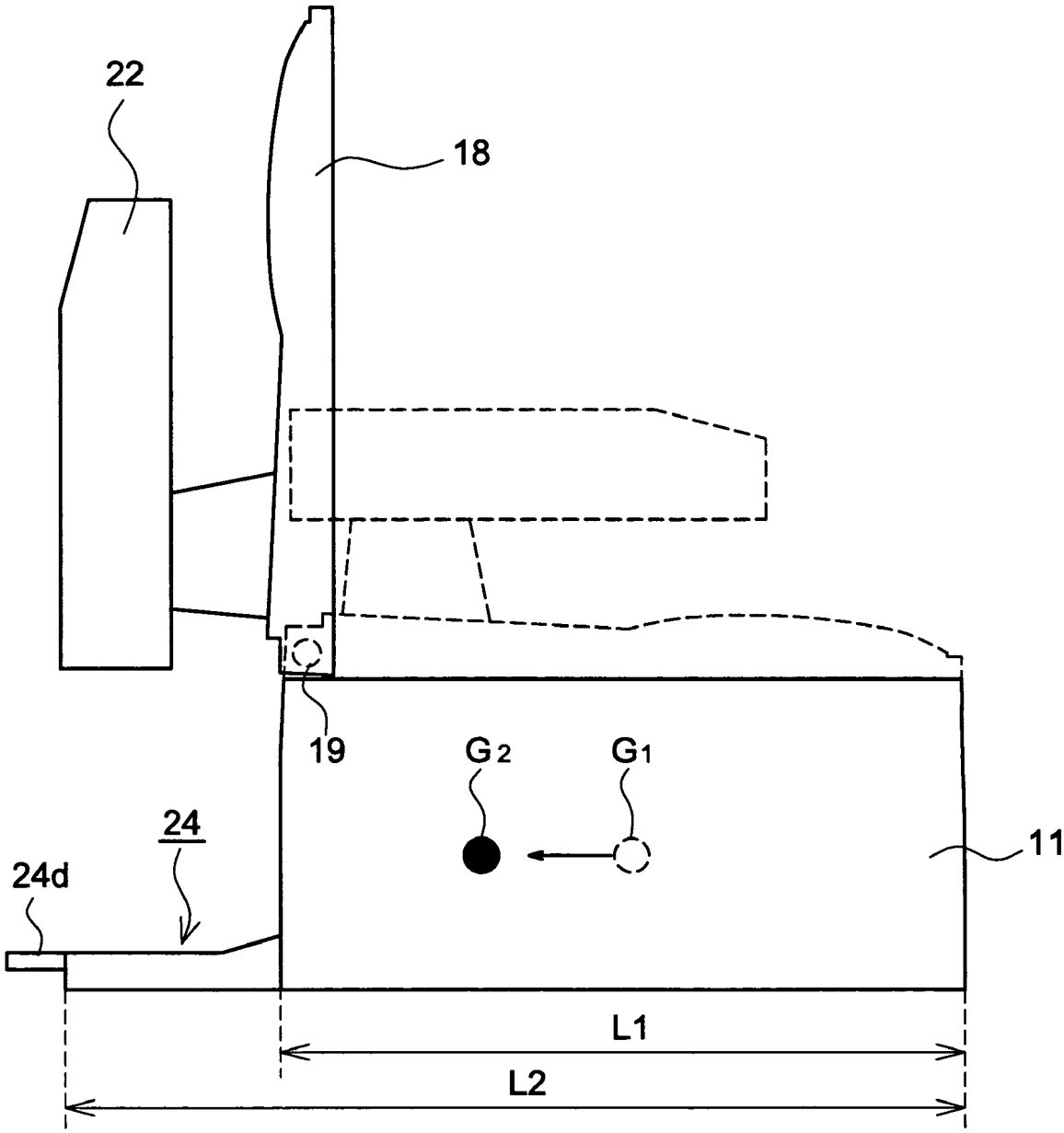
FIG. 5 is a diagram showing the shift of the center of gravity of an MFP in the first embodiment of the invention.

FIG. 1 is a diagram showing the state where an adjusting member of the position of the center of gravity in the first embodiment of the invention has been arranged at a pulling-out position. FIG. 3 is a bottom view of an image forming apparatus in the first embodiment of the invention. FIG. 4 is a diagram showing the state where the adjusting member of the position of the center of gravity in the first embodiment of the invention has been arranged at an enclosing position. FIG. 5 is a diagram showing the shift of the center of gravity of the MFP in the first embodiment of the invention.

In the diagrams, reference numeral 11 denotes the image forming apparatus as a first image processing unit and as an apparatus main body; 21 the sheet as a medium; 12 the sheet cassette as a medium enclosing portion for enclosing the sheets 21; 13 the feed roller as a supply roller which is arranged at the position adjacent to the front edge of the sheet cassette 12 and separates and supplies the sheets 21 one by one; 14 the conveying roller which is arranged on the downstream side of the feed roller 13 in the conveying direction of the sheet 21 and conveys the supplied sheet 21; 15 the sensor as a medium detecting unit for detecting the front edge of the sheet 21 which is conveyed; 16 the image forming unit for forming a toner image as a developer image of each color of black, yellow, magenta, and cyan; 31 the transfer unit for sequentially transferring the toner images formed by the image forming unit 16 onto the sheet 21, thereby forming the color toner image; 17 the fixing unit for fixing the color toner image onto the sheet 21, thereby forming the color image; 18 the top cover as a closable member which is arranged so that it can freely swing around the rotational fulcrum 19 and is opened or closed; and 22 the image reading apparatus which is arranged over the top cover 18 and functions as a second image processing unit having the scanner function. The MFP is constructed by the image forming apparatus 11 and the image reading apparatus 22.

The image forming unit 16 has developing apparatuses (image forming units) 16Bk, 16Y, 16M, and 16C of black, yellow, magenta, and cyan. A photosensitive drum 51 as an image holding member is provided for each of the developing apparatuses 16Bk, 16Y, 16M, and 16C. An LED head 52 as an exposing apparatus is arranged at a position adjacent to each of the developing apparatuses 16Bk, 16Y, 16M, and 16C. The LED head 52 exposes the surface of the photosensitive drum 51 and forms an electrostatic latent image. The transfer unit 31 has: a conveying belt 53 as a conveying member; and a transfer roller 54 as a transfer apparatus arranged so as to face each photosensitive drum 51. The transfer roller 54 transfers the toner image formed on the photosensitive drum 51 onto the sheet 21.

The image forming unit 16 has: a charging roller (not shown) as a charging apparatus for uniformly charging the surface of the photosensitive drum 51; a developing roller (not shown) as a developer holding member for holding toner as a developer and depositing the toner onto the electrostatic latent image on the surface of the photosensitive drum 51, thereby forming the toner image; a cleaning blade (not shown) as a cleaning apparatus for removing the toner remaining on the photosensitive drum 51 after the toner image was transferred onto the sheet 21; and the like.

Reference numeral 56 denotes a head supporting portion which is provided for the top cover 18 and holds each LED head 52; and 24 indicates an adjusting member of a position of a center of gravity. The position adjusting member 24 is arranged so as to be projected in an edge portion of the image forming apparatus 11, is made of a material having high rigidity such as a metal or the like, and adjusts the position of the center of gravity of the MFP. As shown in FIG. 3, the position adjusting member 24 has: a side edge portion 24*a* which has a U-character shape and extends in almost the whole lower edge of a side surface of the image forming apparatus 11; a front edge portion 24*b* which extends in a left half portion of a lower edge of a front surface of the image forming apparatus 11 from a front edge of the side edge portion 24*a*; a rear edge portion 24*c* which extends in a left half portion of a lower edge of a back surface of the image forming apparatus 11 from a rear edge of the side edge portion 24*a*; and a grip portion 24*d* formed so as to be projected from the side edge portion 24*a*.

The adjusting member 24 of the position of the center of gravity is set to an enclosing position where it is enclosed in a casing of the image forming apparatus 11 as shown in FIGS. 3 and 4 and a pulling-out position where it has been pulled out from the casing of the image forming apparatus 11 as shown in FIG. 1 in the direction shown by an arrow A (in FIGS. 3 and 4). To prevent the adjusting member 24 of the position of the center of gravity from being pulled out of the image forming apparatus 11, a pull-out preventing portion 24*e* is formed at an edge of each of the front edge portion 24*b* and the rear edge portion 24*c* (edge portion on the side opposite to the grip portion 24*d*), so that the position adjusting member 24 can be freely pulled out by a length N. Slant portions 24*f* are formed near the pull-out preventing portions 24*e* so that the position adjusting member 24 is not deformed when a large load is applied to the position adjusting member 24.

The length N is set on the basis of a relation between weights of the image forming apparatus 11 and the image reading apparatus 22. When the weight of the image forming apparatus 11 is sufficiently larger than that of the image reading apparatus 22, the length N is set to be short. If there is no difference between them, the length N is set to be long.

In the MFP with the above construction, when the image formed on a predetermined sheet as original paper is copied to another sheet 21, the image is read out by the image reading apparatus 22 and the read-out image data is sent to the image forming apparatus 11. In the image forming apparatus 11, when the image data is received, the feed roller 13 is rotated and the sheet 21 is picked up and fed from the sheet cassette 12. The sheet 21 is conveyed to the position between the image forming unit 16 and the transfer unit 31 by the conveying roller 14.

In the image forming unit 16, the toner image is formed onto each photosensitive drum 51 in accordance with the image data. The toner images are sequentially transferred and overlaid onto the sheet 21 by the transfer rollers 54, so that a color toner image is formed. Subsequently, the sheet 21 is sent to the fixing unit 17. The color toner image is fixed by the fixing unit 17, so that a color image is formed. The sheet 21 is ejected to the outside of the image forming apparatus 11 by a delivery roller 23 and ejected and stacked into a stacker which is formed by the top cover 18. In this manner, the same image as the image which has been read out by the image reading apparatus 22 can be formed.

For example, there is a case where an inconvenience such as a conveyance jam or the like occurs for a period of time during which the sheet 21 is fed and ejected to the outside of the image forming apparatus 11. In such a case, it is necessary to remove the sheet 21. If the end of a service life of the consumables such as an image forming unit 16 or the like has come, it is necessary to exchange the consumables or the developing apparatuses 16Bk, 16Y, 16M, and 16C.

In the case of performing such a maintenance of the image forming apparatus 11, as shown in FIG. 5, the top cover 18 is opened and the work is executed. However, since the image reading apparatus 22 attached to the top cover 18 is constructed by parts such as motor, circuit board, sheet metal, and the like (not shown) and heavy, when the top cover 18 is opened, a center of gravity G of the MFP is shifted to one end side of the image forming apparatus 11, that is, to the side where the rotational fulcrum 19 exists. Particularly, in the case where the image forming unit 16, the fixing unit 17, and the like are taken out of the image forming apparatus 11 in order to eliminate the inconvenience such as a conveyance jam or the like, since the head supporting portions 56 are arranged in the top cover 18, it is necessary to open the top cover 18 by an angle of about 90° so that the image forming unit 16, the fixing unit 17, and the like are not interfered with the LED heads 52. If the image forming unit 16, the fixing unit 17, and the like are removed from the image forming apparatus 11, the main body of the image forming apparatus 11 is lightened by the weight corresponding to them, so that the center of gravity G of the MFP is shifted to the side where the rotational fulcrum 19 exists.

In the embodiment, therefore, as mentioned above, in the edge portion where the center of gravity G of the image forming apparatus 11 is shifted, the adjusting member 24 of the position of the center of gravity is arranged out of the apparatus main body so that it can be freely enclosed. The position adjusting member 24 is located at the enclosing position in the state where the top cover 18 has been closed. The position adjusting member 24 is located at the pulling-out position when the top cover 18 is opened.

That is, a center of gravity G1 located at an almost center of a length L1 of MFP in the state where the top cover 18 has been closed is shifted to the side where the rotational fulcrum 19 exists by opening the top cover 18 and is set to a position of a center of gravity G2. However, when the position adjusting member 24 is located at the pulling-out position, a bottom surface of the MFP is extended to the side where the rotational fulcrum 19 exists, that is, in the moving direction from the center of gravity G1 to the center of gravity G2. Consequently, the center of gravity G2 can be located at an almost center of a length L2 of bottom surface including the position adjusting member 24 of the MFP. Therefore, since the top cover 18 can be opened by the angle of about 90°, when the maintenance of the MFP is performed, for example, the operability at the time of eliminating the sheet jam on the medium conveying path or exchanging the consumables such as image forming unit 16, the fixing unit 17, and the like can be improved.

If there is no need to open the top cover 18 when the MFP is transported or kept, since the position adjusting member 24 can be located at the enclosing position, an occupation area of the MFP can be reduced.

Further, the length N is set on the basis of the relation between the weights of the image forming apparatus 11 and the image reading apparatus 22. When the weight of the image forming apparatus 11 is sufficiently larger than that of the image reading apparatus 22, the length N is set to be short. If there is no difference between them, the length N is set to be long. Thus, the occupation area of the MFP can be reduced. The position adjusting member 24 is arranged only to the surface in one direction of the MFP corresponding to the shifting direction of the center of gravity, in the invention, only to the side surface on the side where the rotational fulcrum 19 exists. Therefore, the occupation area of the MFP at the time when the position adjusting member 24 has been pulled out can be reduced.

The second embodiment of the invention will now be described. Component elements having the same or similar structures as those in the first embodiment will be designated by the same reference numerals and their explanation is omitted. With respect to the effects of the invention which are obtained by the component elements having the same or similar structures, the effects of the embodiments are used in common. Since a structure of an image forming apparatus in the second embodiment is similar to that in the first embodiment, it will be explained also with reference to FIG. 1 in common.

Figure 6:
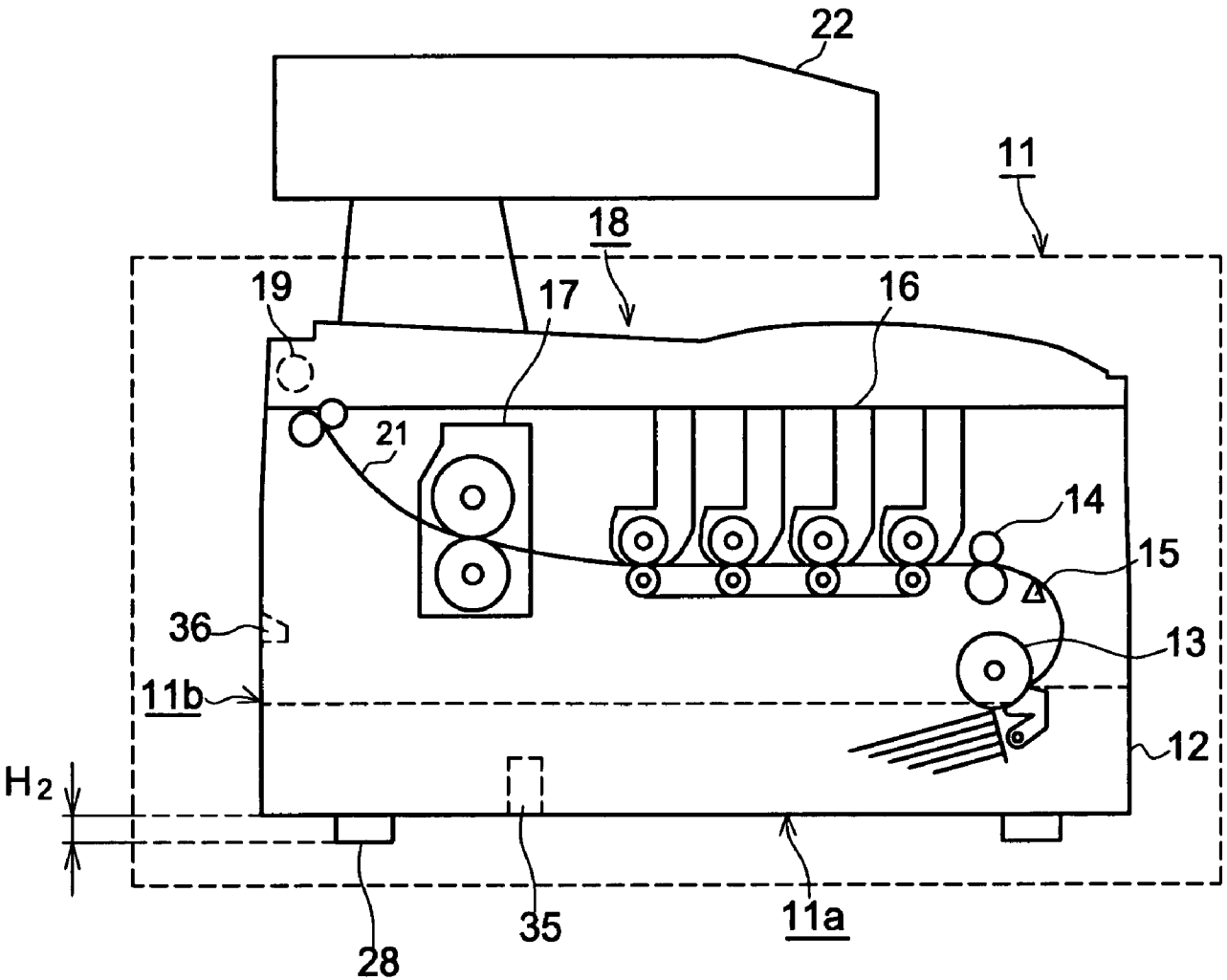
FIG. 6 is a schematic diagram of an MFP from which an adjusting member of the position of the center of gravity in the second embodiment of the invention has been removed.
Figure 7:
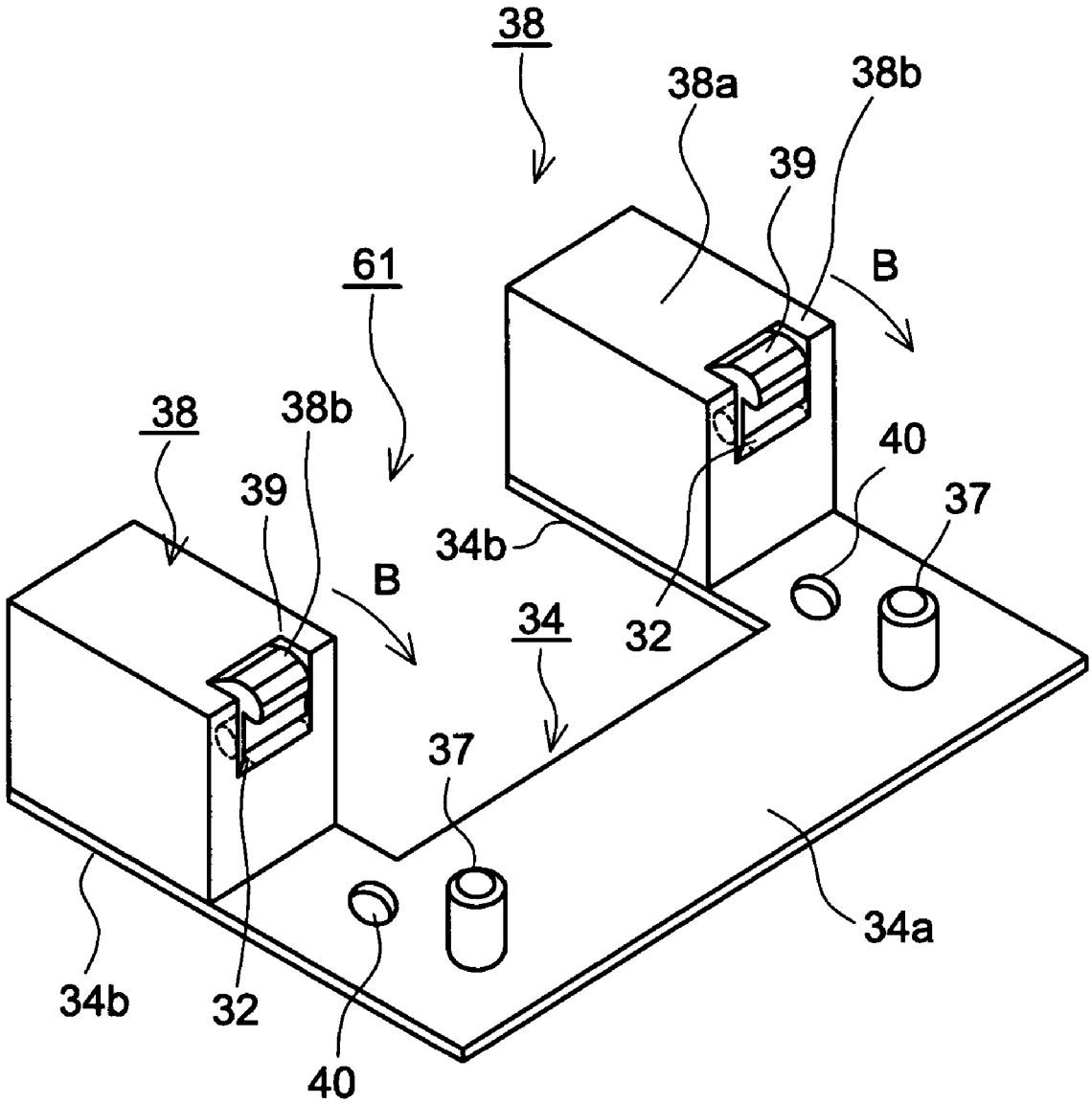
FIG. 7 is a perspective view of the adjusting member of the position of the center of gravity in the second embodiment of the invention.
Figure 8:
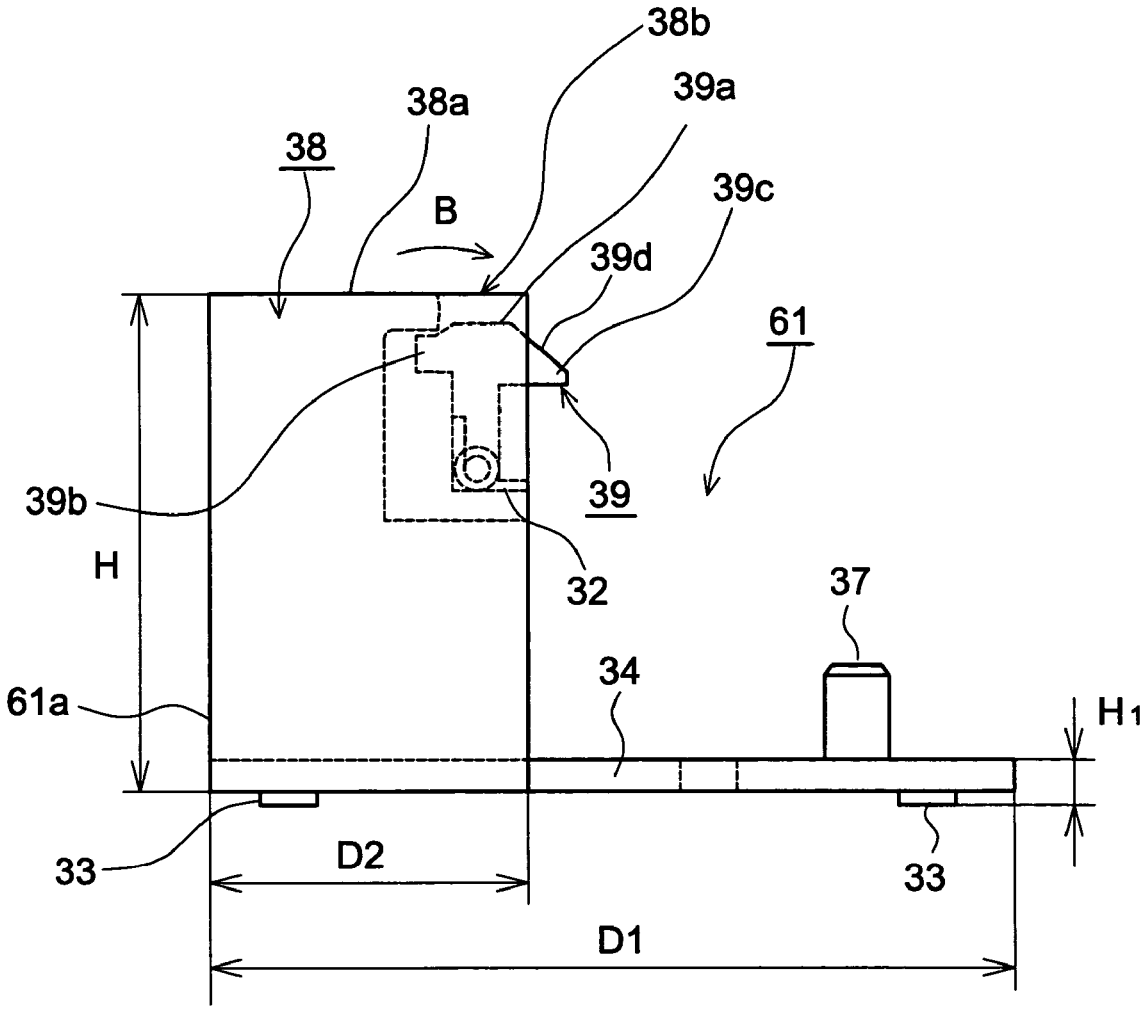
FIG. 8 is a front view of the adjusting member of the position of the center of gravity in the second embodiment of the invention.
Figure 9:
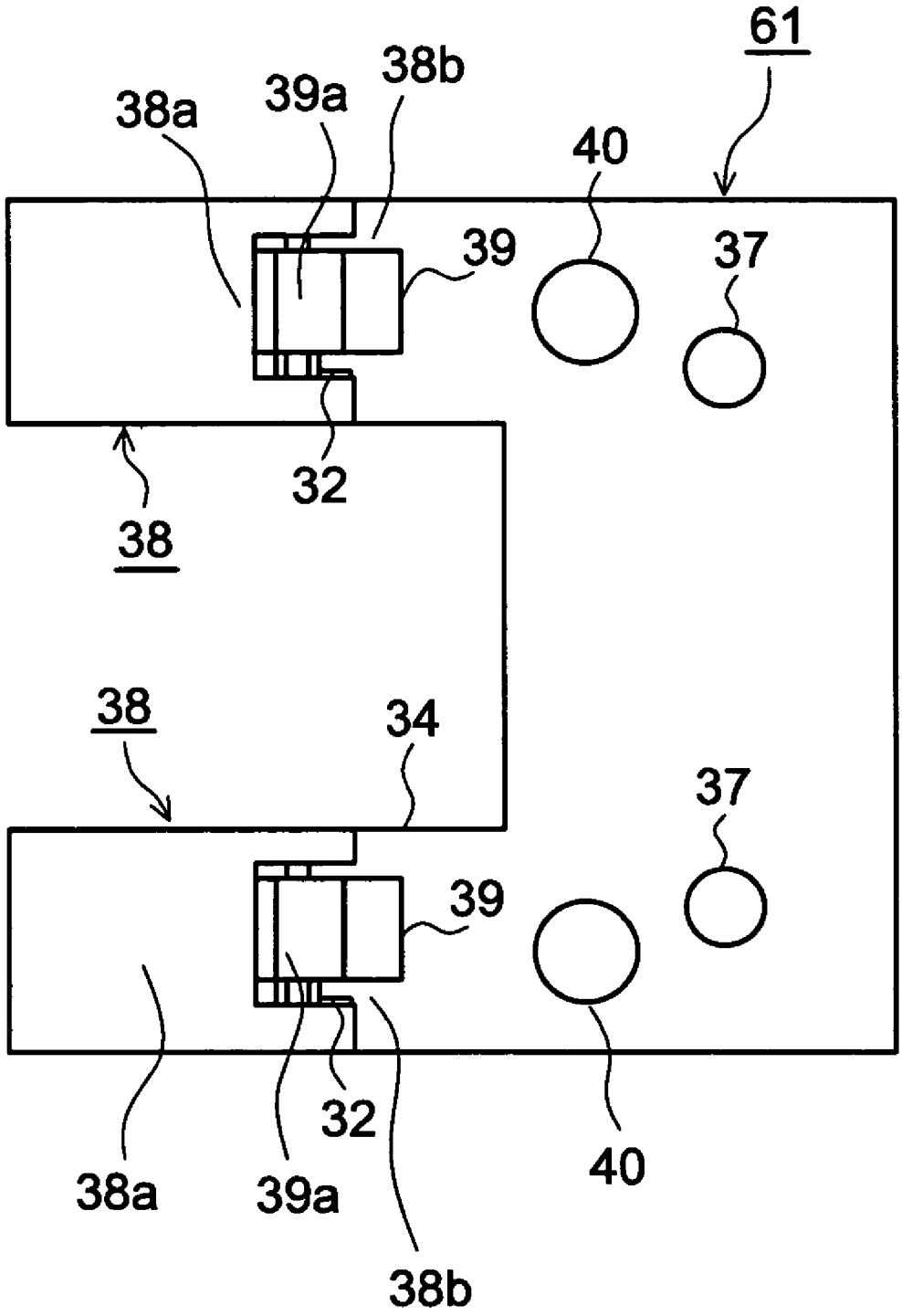
FIG. 9 is a plan view of the adjusting member of the position of the center of gravity in the second embodiment of the invention.
Figure 10:
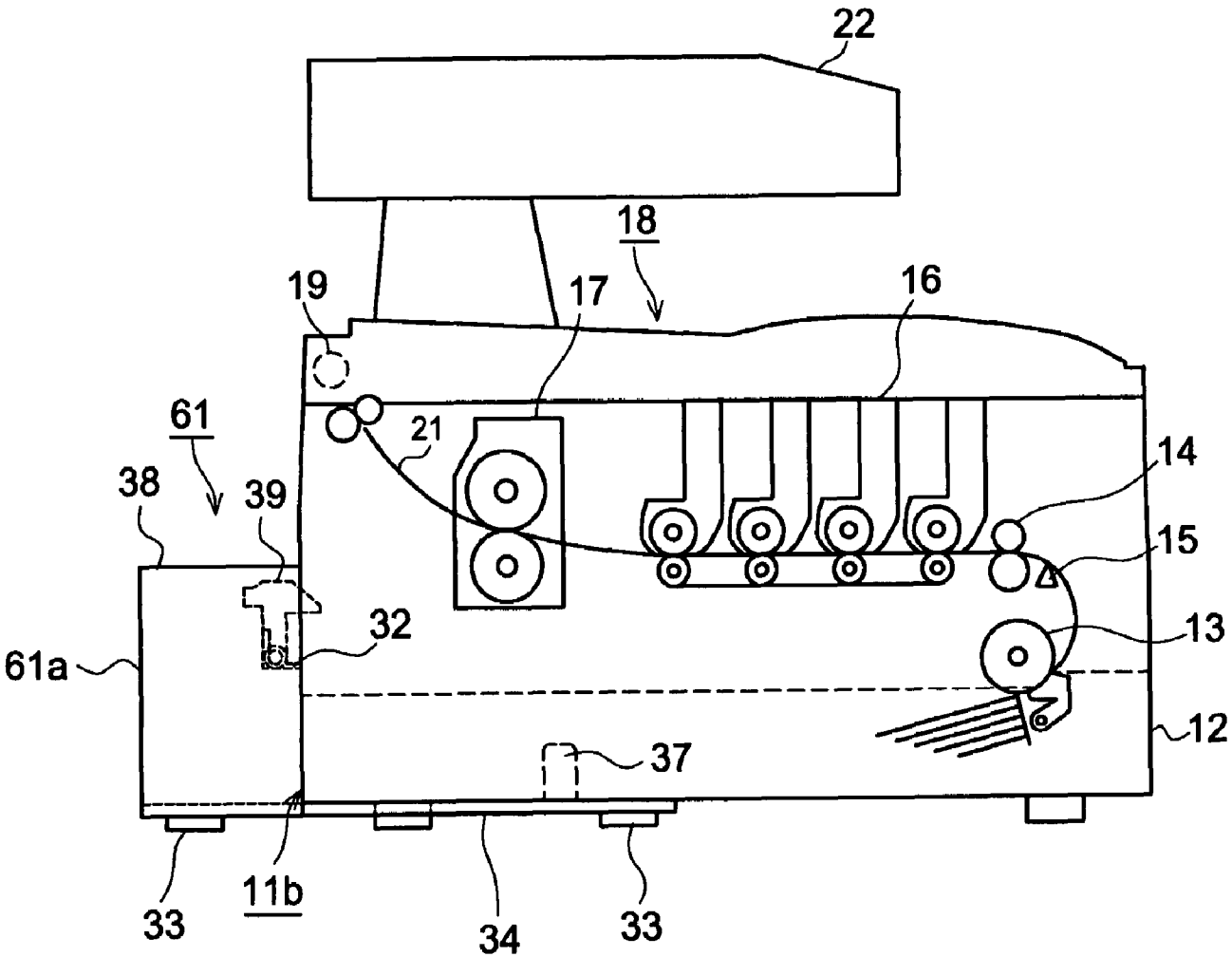
FIG. 10 is a schematic diagram of the MFP in which the adjusting member of the position of the center of gravity in the second embodiment of the invention has been set.
Figure 11:
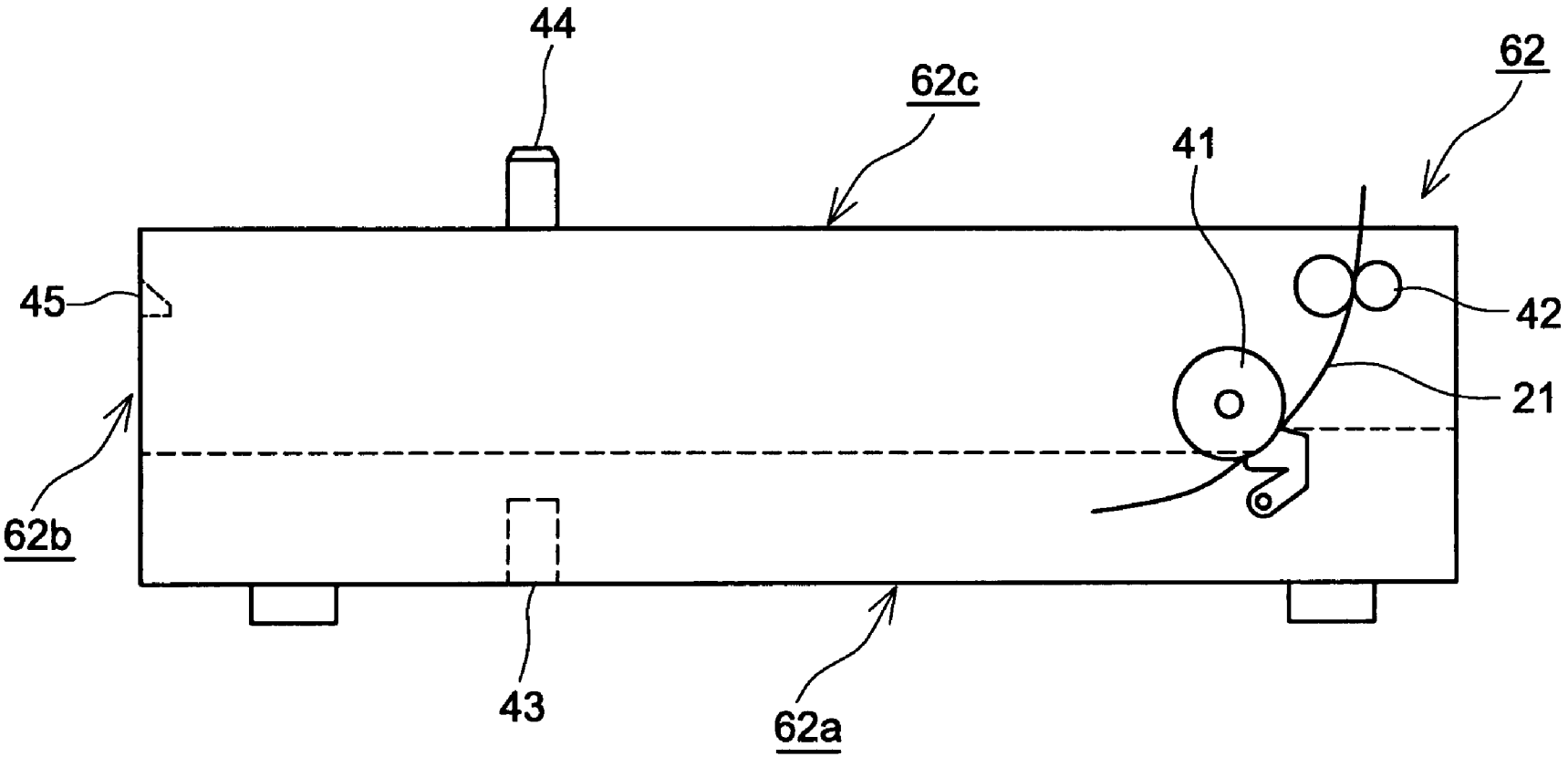
FIG. 11 is a front view of an auxiliary tray in the second embodiment of the invention.
Figure 12:
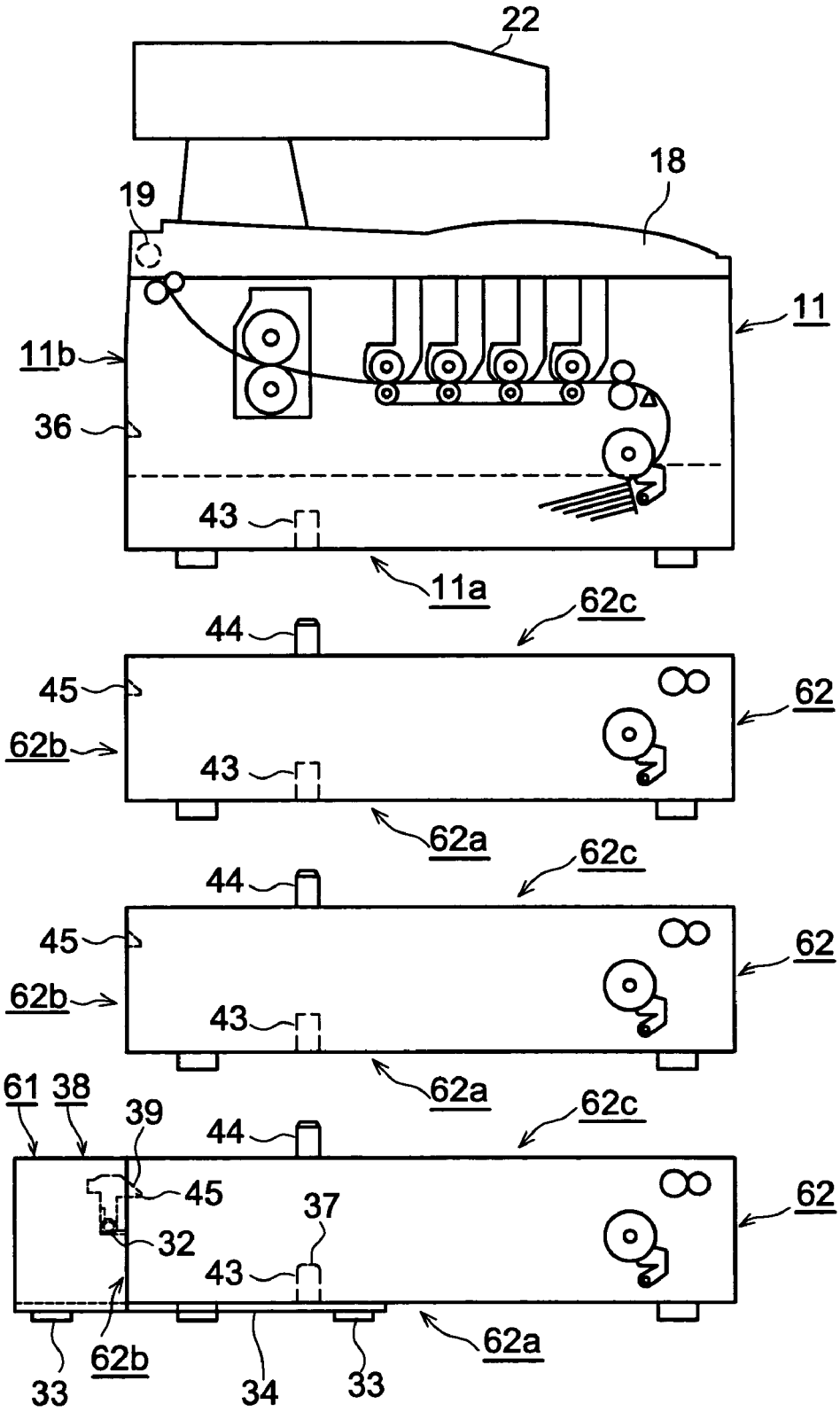
FIG. 12 is an assembly diagram of the MFP in the case of using a plurality of auxiliary cassettes in the second embodiment of the invention.

FIG. 6 is a schematic diagram of an MFP from which the adjusting member of the position of the center of gravity in the second embodiment of the invention has been removed. FIG. 7 is a perspective view of the adjusting member of the position of the center of gravity in the second embodiment of the invention. FIG. 8 is a front view of the adjusting member of the position of the center of gravity in the second embodiment of the invention. FIG. 9 is a plan view of the adjusting member of the position of the center of gravity in the second embodiment of the invention. FIG. 10 is a schematic diagram of the MFP in which the adjusting member of the position of the center of gravity in the second embodiment of the invention has been set. FIG. 11 is a front view of an auxiliary tray in the second embodiment of the invention. FIG. 12 is an assembly diagram of the MFP in the case of using a plurality of auxiliary cassettes in the second embodiment of the invention.

In this case, recess portions 35 (only one of the two recess portions 35 is shown in FIG. 6) serving as first engagement portions are formed in two positions of a bottom surface 11*a* of the image forming apparatus 11 as a first image processing unit and as an apparatus main body, and two grooves 36 (only one of the two grooves 36 is shown in FIG. 6) serving as second engagement portions are formed in two positions of a side surface 11*b*. An adjusting member 61 of a position of a center of gravity is detachably arranged in a region from the bottom surface 11*a* to the side surface 11*b* of the image forming apparatus 11. The adjusting member 61 of the position of the center of gravity has: a plate-shaped member 34 having a base portion 34*a* and two arm portions 34*b* extending from both edges of the base portion 34*a* and having a U-character shape; positioning pins 37 as first engaging portions which are formed in two positions of the base portion 34*a* so as to be upwardly projected and have a shape adapted to be fitted into the recess portions 35; and block-shaped convex portions 38 fixed to the arm portions 34*b*. Hole portions 40 in which leg portions 28 which are arranged on the bottom surface of the image forming apparatus 11 (in FIG. 6, among the four leg portions which are arranged on the bottom surface of the image forming apparatus 11, only one of the two leg portions 28 which are arranged on the side of a supporting member 33 is illustrated) are inserted are formed in the plate-shaped member 34.

A claw portion 39 as a second engaging portion which is arranged so that it can freely swing and has a hook-like shape and a spring 32 serving as an urging member for urging the claw portion 39 in the direction shown by an arrow B are provided in a portion (of the convex portions 38) which faces the side surface 11*b*. The claw portion 39 has an inner projecting portion 39*b* which is projected into the convex portions 38. The inner projecting portion 39*b* of the claw portion 39 which is urged in the direction of the arrow B is retained by an upper surface portion 38*a* of the convex portions 38, thereby preventing the claw portion 39 from being rotated in the direction of the arrow B. Thus, in the normal state, the claw portion 39 is set to a position where an outer projecting portion 39*c* at a front edge is projected from a front surface of the convex portion 38. The elastic members 33 serving as supporting members are arranged in two portions of a bottom surface of the member 34. Therefore, when a shock is applied to the position adjusting member 61, it is possible to suppress the occurrence of a slip in the image forming apparatus 11, so that a balance of the MFP can be held. It is also possible to prevent a scratch from being formed on a surface of a table or the like on which the image forming apparatus 11 has been placed. It is preferable that the elastic members 33 are made of a rubber material. A total height H1 of the plate-shaped member 34 and the elastic member 33 is almost equal to a height H2 of leg portion 28. It is most desirable that the heights H1 and H2 are equal.

In the embodiment, assuming that a weight of the image reading apparatus 22 as a second image processing unit is equal to about 6 kg, a weight of the image forming apparatus 11 is equal to about 26 kg, a weight of the image forming unit 16 is equal to about 5 kg, and a weight of the fixing unit 17 is equal to about 1.5 kg, a total weight of the image forming apparatus 11 from which the image forming unit 16 and the fixing unit 17 have been removed is equal to about 19.5 kg. In this case, the center of gravity G of the MFP is shifted to the side where the rotational fulcrum 19 exists.

In the embodiment, therefore, the adjusting member 61 of the position of the center of gravity is arranged as mentioned above.

As shown in FIG. 8, a length D1 of member 34 is set to 230 mm, a length D2 of convex portion 38 is set to 100 mm, and a height H of convex portion 38 is set to 60 mm. The length D2 of convex portion 38 is set in such a manner that when the top cover 18 of the image forming apparatus 11 is opened, the image reading apparatus 22 is not protruded from a side surface 61*a* of the position adjusting member 61, that is, the image reading apparatus 22 is located on the inner side of the side surface 61*a*.

In the MFP with the foregoing structure, in the case of setting the position adjusting member 61 to the image forming apparatus 11, if the image forming apparatus 11 is moved downward at a position where the positioning pins 37 as protruding portions formed in the position adjusting member 61 are inserted into the recess portions 35 formed in the bottom surface 11*a* of the image forming apparatus 11, slant portions 39*d* which are formed to the outer projecting portions 39*c* of the claw portions 39 are pressed to the side surface 61*a* side of the convex portion 38 by the side surface 11*b* of the image forming apparatus 11. Therefore, the claw portions 39 are rotated in the direction opposite to the direction of the arrow B in FIG. 8 against the urging force of the springs 32. When the image forming apparatus 11 is further moved downward as it is and the grooves 36 formed in the side surface 11*b* of the image forming apparatus 11 reach the positions of the claw portions 39, the positioning pins 37 are inserted into the recess portions 35 and the claw portions 39 are rotated in the direction of the arrow B by the urging force of the springs 32 and enter the grooves 36. As shown in FIG.

10, the position adjusting member 61 is set to the image forming apparatus 11. The leg portions 28 which are arranged on the bottom surface of the image forming apparatus 11 are inserted into the hole portions 40 which are formed in the position adjusting member 61.

Since the positioning pins 37 are inserted into the recess portions 35 and the claw portions 39 are retained to the grooves 36, even if the MFP is lifted up, the position adjusting member 61 is not removed from the image forming apparatus 11 and does not drop.

When the position adjusting member 61 is detached from the image forming apparatus 11, upper portions 39*a* of the claw portions 39 are pressed from opening portions 38*b* which are formed in the upper surface portions 38*a* of the convex portions 38, thereby rotating the claw portions 39 in the direction opposite to the direction of the arrow B. When the image forming apparatus 11 is moved upward by disengaging the outer projecting portions 39*c* from the grooves 36, the positioning pins 37 are removed from the recess portions 35. In this manner, the position adjusting member 61 can be detached from the image forming apparatus 11.

An auxiliary cassette 62 as an auxiliary tray as shown in FIG. 11 is arranged as an option of the image forming apparatus 11. By attaching the auxiliary cassette 62 to a lower portion of the image forming apparatus 11, a multi-tray can be constructed.

In FIG. 11, reference numeral 41 denotes a feed roller as a supply roller for separating and supplying one by one the sheets 21 as media enclosed in the auxiliary cassette 62 as an auxiliary medium enclosing portion; and 42 indicates a conveying roller which is arranged on a downstream side of the feed roller 41 in the conveying direction of the sheet 21 and conveys the sheet 21.

Recess portions 43 as first engagement portions (only one of the two recess portions 43 is shown in FIGS. 11 and 12) are formed in two portions of a bottom surface 62*a* of the auxiliary cassette 62. Grooves 45 as second engagement portions (only one of the two grooves 45 is shown in FIGS. 11 and 12) are formed in two portions of a side surface 62*b* of the auxiliary cassette 62. Positioning pins 44 as first engaging portions (only one of the two positioning pins 44 is shown in FIGS. 11 and 12) are formed in two portions of an upper surface 62*c* of the auxiliary cassette 62.

In the case of using the auxiliary cassette 62, if the position adjusting member 61 is removed from the image forming apparatus 11 by the procedure as mentioned above and the auxiliary cassette 62 is moved downward at the position where the positioning pins 37 are inserted into the recess portions 43 formed in the bottom surface 62*a* of the lowest auxiliary cassette 62 of the multi-tray, the slant portions 39*d* which are formed to the outer projecting portions 39*c* of the claw portions 39 are pressed to the side surface 61*a* side of the convex portion 38 by the side surface 62*b* of the auxiliary cassette 62. Therefore, the claw portions 39 are rotated in the direction opposite to the direction of the arrow B in FIG. 8 against the urging force of the springs 32. When the auxiliary cassette 62 is further moved downward as it is and the grooves 45 formed in the side surface 62*b* of the auxiliary cassette 62 reach the positions of the claw portions 39, the positioning pins 37 are inserted into the recess portions 43 and the claw portions 39 are rotated in the direction of the arrow B by the urging force of the springs 32 and enter the grooves 45. As shown in FIG. 12, the position adjusting member 61 is set to the auxiliary cassette 62.

As mentioned above, after the position adjusting member 61 was set to the lowest auxiliary cassette 62, the auxiliary cassettes 62 are piled so that the positioning pins 44 are inserted into the recess portions 43 formed in the bottom surface 62*a* of another auxiliary cassette 62. The image forming apparatus 11 is piled so that the positioning pins 44 are inserted into the recess portions 35 formed in the bottom surface 11*a* of the image forming apparatus 11. In this manner, the multi-tray can be set to the image forming apparatus 11.

As mentioned above, by opening the top cover 18 in the state where the top cover 18 has been closed, the center of gravity G locating at almost the center of the length of MFP is shifted to the side where the rotational fulcrum 19 exists. However, the position adjusting member 61 is set, the bottom surface of the MFP is widened in the direction where the center of gravity G has been shifted, and the center of gravity can be positioned at almost the center of the length of bottom surface of the MFP. Therefore, since the top cover 18 can be opened up to about 90°, in the case of performing the maintenance of the MFP, for example, the operability at the time when the sheet jam which has occurred on the medium conveying path is eliminated or the consumables such as image forming unit 16, fixing unit 17, or the like are exchanged can be improved.

When the MFP is conveyed or kept, if there is no need to open the top cover 18, since the adjusting member 61 of the position of the center of gravity can be removed, the occupation area of the MFP can be reduced.

Since the positions and shapes of the recess portions 35 and the grooves 36 for setting the position adjusting member 61 to the image forming apparatus 11 are made identical to those of the recess portions 43 and the grooves 45 for setting the auxiliary cassette 62 to the image forming apparatus 11, even when the auxiliary cassette 62 is used, the same position adjusting member 61 can be used. Therefore, when the auxiliary cassette 62 is used, the position adjusting member 61 does not become an obstacle and there is no need to newly arrange the adjusting member of the position of the center of gravity for the auxiliary cassette 62.

Although each of the above embodiments has been described with respect to the multi function printer in which the image forming apparatus 11 and the image reading apparatus 22 are combined as image processing apparatuses, the invention can be applied to an image processing apparatus in which a printer, a copying apparatus, a facsimile apparatus, a scanner, and the like are arbitrarily combined.

The invention is not limited to the foregoing embodiments but many variations and modifications are possible on the basis of the spirit of the invention and are not excluded from the scope of the invention.

It should be understood by those skilled in the art that various modifications, combinations, sub-combinations and alterations may occur depending on design requirements and other factors insofar as they are within the scope of the appended claims or the equivalents thereof.

What is claimed is:

1. An image processing apparatus in which a closable member is arranged in an upper portion of an apparatus main body and a center of gravity is shifted by opening said closable member, comprising:

an adjusting member of a position of the center of gravity which is arranged out of the apparatus main body in an edge portion on the side where the center of gravity in said apparatus main body is shifted and which is formed so as to be projected from said apparatus main body.

2. The image processing apparatus according to claim 1, wherein said adjusting member of the position of the center of gravity is arranged so that it can be enclosed in the apparatus main body.

3. The image processing apparatus according to claim 1, wherein said adjusting member of the position of the center of gravity is arranged so as to be detachable for the apparatus main body.

4. The image processing apparatus according to claim 3, wherein said adjusting member of the position of the center of gravity is set into the apparatus main body by allowing engaging portions to be come into engagement with engagement portions.

5. The image processing apparatus according to claim 3, wherein said adjusting member of the position of the center of gravity is set into an auxiliary tray by allowing an engaging portion to be come into engagement with an engagement portion.

6. The image processing apparatus according to claim 3, wherein an elastic member is arranged on a bottom portion of said adjusting member.

7. The image processing apparatus according to claim 3, wherein said adjusting member has:

engaging portions which are come into engagement with groove portions formed in the apparatus main body; and urging members which urge said engaging portions in such a direction as to be come into engagement with said groove portions.

8. An adjusting member of a position of a center of gravity, comprising:

a plate-shaped base portion which is flat in a horizontal direction;

arm portions extending in a same direction in both edge portions of said base portion; and block-shaped convex portions projecting upward from said arm portions.

9. The adjusting member according to claim 8, wherein said base portion has protruding portions protruding upward from said base portion and hole portions.

10. The adjusting member according to claim 8, wherein said convex portions have:

claw portions projecting from said convex portions; and urging members which urge said claw portions in their projecting direction.

11. An adjusting member of a position of a center of gravity which is detachable for an image processing apparatus for reading an original sheet and forming an image of contents of said original sheet, comprising:

a plate-shaped base portion which faces a bottom surface of said image processing apparatus;

arm portions extending in a same direction in both edge portions of said base portion; and block-shaped convex portions projecting upward from said arm portions, wherein said base portion has protruding portions protruding upward and hole portions.

12. The adjusting member according to claim 11, wherein said base portion has:

said protruding portions which protrude upward from said base portion and are come into engagement with recess portions of said image processing apparatus; and the hole portions which enclose leg portions of said image processing apparatus.

13. The adjusting member according to claim 11, wherein said convex portions have:

claw portions which are arranged so as to be projected from said convex portions and are come into engagement with groove portions of said image processing apparatus; and urging members which urge said claw portions in their projecting direction.

* * * * *